US010396448B2

(12) United States Patent
Schmutzler

(10) Patent No.: US 10,396,448 B2
(45) Date of Patent: Aug. 27, 2019

(54) RADOME END CAP WITH BULK HEAD MOUNT CONNECTOR

(71) Applicant: CommScope Technologies LLC, Hickory, NC (US)

(72) Inventor: Steven Lee Schmutzler, Homer Glen, IL (US)

(73) Assignee: CommScope Technologies LLC, Hickory, NC (US)

( * ) Notice: Subject to any disclaimer, the term of this patent is extended or adjusted under 35 U.S.C. 154(b) by 12 days.

(21) Appl. No.: 15/752,467

(22) PCT Filed: Aug. 12, 2016

(86) PCT No.: PCT/US2016/046726
§ 371 (c)(1),
(2) Date: Feb. 13, 2018

(87) PCT Pub. No.: WO2017/030939
PCT Pub. Date: Feb. 23, 2017

(65) Prior Publication Data

US 2019/0013575 A1 Jan. 10, 2019

Related U.S. Application Data

(60) Provisional application No. 62/206,357, filed on Aug. 18, 2015.

(51) Int. Cl.
*H01Q 1/42* (2006.01)
*H01Q 1/24* (2006.01)

(52) U.S. Cl.
CPC ..... *H01Q 1/42* (2013.01); *H01Q 1/246* (2013.01)

(58) Field of Classification Search
CPC ..... H01Q 1/146; H01Q 1/42; H01Q 9/34
(Continued)

(56) References Cited

U.S. PATENT DOCUMENTS 5,259,790 A 11/1993 Hayward
5,474,478 A * 12/1995 Ballog ..... H01R 9/0521 439/578

(Continued)

FOREIGN PATENT DOCUMENTS

CN 202797246 U 3/2013
CN 203631720 U 6/2014

OTHER PUBLICATIONS

International Search Report corresponding to International Application No. PCT/US2016/046726, dated Nov. 21, 2016.

(Continued)

*Primary Examiner* — Huedung X Mancuso
(74) *Attorney, Agent, or Firm* — Myers Bigel, P.A.

(57) ABSTRACT

An apparatus includes an end cap capable of supporting numerous antenna configurations and securing connectors without the use of additional hardware. An end cap assembly for connecting a cable to the end cap comprises the end cap including one or more flanges, wherein each of the one or more flanges includes a plurality of edges defining a cavity, the plurality of edges being configured to mate with a portion of a connector, and a flange nut including a first plurality of serrations configured to mate with a second plurality of serrations on an outside of the end cap, wherein the flange nut and the flange are formed so as to allow for attachment of the cable to the end cap.

12 Claims, 18 Drawing Sheets

(58) Field of Classification Search
USPC ..... 343/872
See application file for complete search history.

(56) References Cited

U.S. PATENT DOCUMENTS

| | | | | |
|---|---|---|---|---|
| 5,588,086 | A | 12/1996 | Fan | |
| 6,067,395 | A * | 5/2000 | Cairns | H02G 15/14 385/138 |
| 6,146,208 | A * | 11/2000 | Pennell | H01R 13/646 439/578 |
| 6,491,546 | B1 * | 12/2002 | Perry | H01R 24/542 439/133 |
| 6,640,110 | B1 * | 10/2003 | Shapira | H01Q 1/246 455/562.1 |
| 2015/0156642 | A1 | 6/2015 | Sobczak et al. | |

OTHER PUBLICATIONS

Written Opinion corresponding to International Application No. PCT/US2016/046726, dated Nov. 21, 2016.
Notification Concerning Transmittal of International Preliminary Report on Patentability corresponding to International Application No. PCT/US2016/046726, dated Mar. 1, 2018.

* cited by examiner

RADOME END CAP WITH BULK HEAD MOUNT CONNECTOR

RELATED APPLICATION

The present application claim priority from and the benefit of U.S. Provisional Patent Application No. 62/206,357, filed Aug. 18, 2015, the disclosure of which is hereby incorporated herein in its entirety.

FIELD OF THE INVENTION

Various embodiments of the present disclosure relate to base station antennae, and, more particularly, to apparatus for securing a connector to an end cap to a base station antenna.

BACKGROUND

Currently, there exist many base station antenna types, shapes, and sizes. An end cap of a base station antenna may snap onto a radome to seal and protect the antenna from adverse environmental conditions. The end cap may have a plurality of connectors attached thereto, to electrically connect other components (e.g., dipoles) of the antenna with an external device such as a receiver or transmitter. Due to the wide variation of base station antenna and antenna configurations, brackets, end caps, and other hardware may need to be customized for each antenna configuration, at least for securing connectors to the end cap for connection to other components. Design and implementation of this additional hardware may be burdensome and costly. Further, additional hardware may increase passive intermodulation distortion (PIM) associated with the antenna causing degradation of antenna performance.

PIM is a form of electrical interference/signal transmission degradation that may occur with less than symmetrical interconnections and/or as electro-mechanical interconnections shift or degrade over time, for example due to mechanical stress, vibration, thermal cycling, and/or material degradation. PIM is an important interconnection quality characteristic as PIM generated by a single low quality interconnection may degrade the electrical performance of an entire RF system.

As such, it would be desirable to have an end cap capable of supporting numerous antenna configurations and securing connectors without the use of additional hardware.

SUMMARY

As a first aspect, embodiments of the invention are directed to an end cap assembly for connecting a cable to an end cap, comprising: an end cap including one or more flanges, each of the one of more flanges include a plurality of edges defining a cavity, the plurality of edges being configured to mate with a portion of a connector; and a flange nut including a first plurality of serrations configured to mate with a second plurality of serrations on an outside of the end cap; wherein the flange nut and the flange are formed so as to allow for attachment of the cable to the end cap.

As a second aspect, embodiments of the invention are directed to an end cap assembly for connecting a cable to an end cap, comprising: an end cap including one or more generally circular flanges surrounding a hole, each of the one of more flanges include a plurality of edges defining a cavity, the plurality of edges being configured to mate with a portion of a connector; and a flange nut including a first plurality of serrations configured to mate with a second plurality of serrations on an outside of the end cap; wherein the flange nut, the hole and the flange are formed so as to allow for insertion and capture of a connector in the end cap.

BRIEF DESCRIPTION OF THE SEVERAL VIEWS OF THE DRAWINGS

The following detailed description of the disclosure will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown.

In the drawings.

DETAILED DESCRIPTION OF VARIOUS EMBODIMENTS

Figure 1:
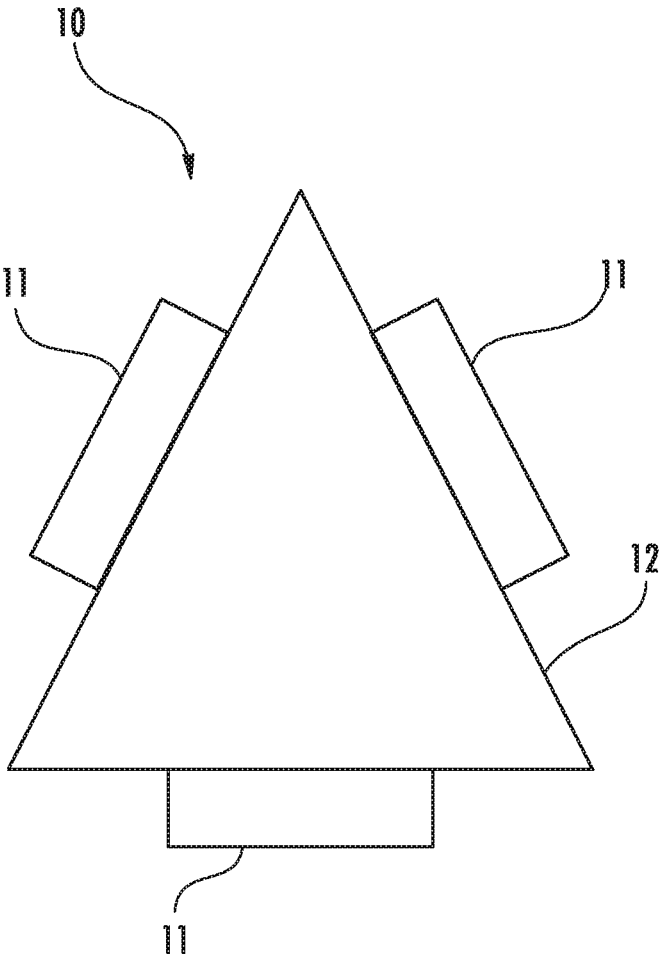
FIG. 1 is a plan view of a cell site having base station antennae, according to an aspect of the present disclosure.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

FIG. 1 is a plan view of a cell site having base station antennae. The cell site 10 generally comprises a triangular platform 12 which may be mounted atop an antenna tower (not shown), or other suitable structure, such as a building (not shown). The platform includes a first side, a second side, and a third side, each of which have a base station antenna 11.

The base station antenna 11 may be housed by an enclosure such as a radome (not shown). An end cap (not shown) may snap onto the radome to seal and protect the antenna from adverse environmental conditions. The end cap may have a plurality of connectors attached thereto, to electrically connect other components (e.g., dipoles) of the antenna with an external device such as a receiver or transmitter.

Due at least in part to the large variation of base station antenna types, shapes, and sizes, implementation can be burdensome and costly. For example, at least because of different antenna configurations, brackets, end caps, and other hardware may need to be customized (e.g., specifically manufactured) for each antenna configuration. Aspects of the present disclosure include an end cap capable of supporting numerous antenna models and configurations. The end cap includes molded features allowing for connectors for various antenna models to be snapped into the end cap, without the use of other hardware and formed end bracket assemblies, such as aluminum end bracket assemblies. Also, aspects of the present disclosure may eliminate the need to solder connectors in a specific orientation. Consequently, assembly time may be reduced, and passive intermodulation (PIM) attributed to the use of additional hardware may be reduced or otherwise eliminated.

Figure 2:
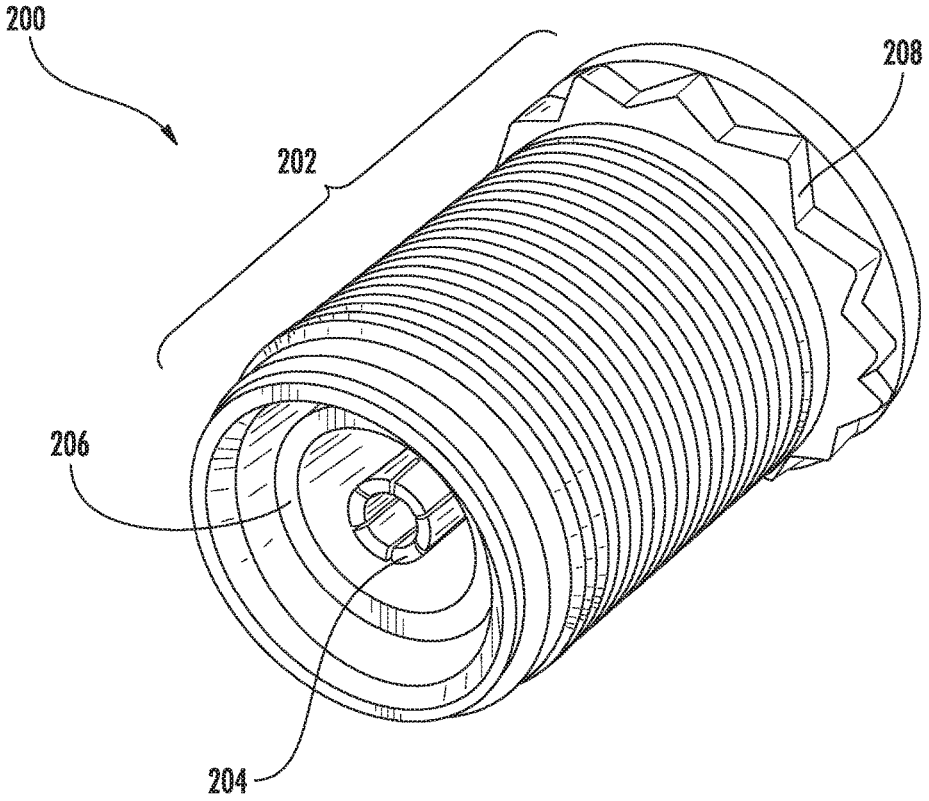
FIG. 2 is a perspective view of a connector according to an aspect of the present disclosure.

FIG. 2 is a perspective view of the connector 200 which may be employed according to aspects of the disclosure. The connector 200 may be made from an electrically conductive material (such as, for example, brass). The connector 200 may include communications contacts housed in a body 202 for communicatively connecting elements joined thereto. For example, FIG. 2 shows the body 202 housing an inner contact 204 and an outer contact 206 that provide a conductive path or other communication mechanism between the connector 200 and elements connected thereto. The body 202 may also include a polygonal portion 208. The connector 200 may preferably take the form of a 4.3/10 bulkhead connector. However, it should be noted that the connector 200 may also take the form of a 7/16 Deutsches Institut für Normung (or "DIN") female connector. Alternate communications contacts are also possible, depending on the configuration of elements to be connected.

Figure 3:
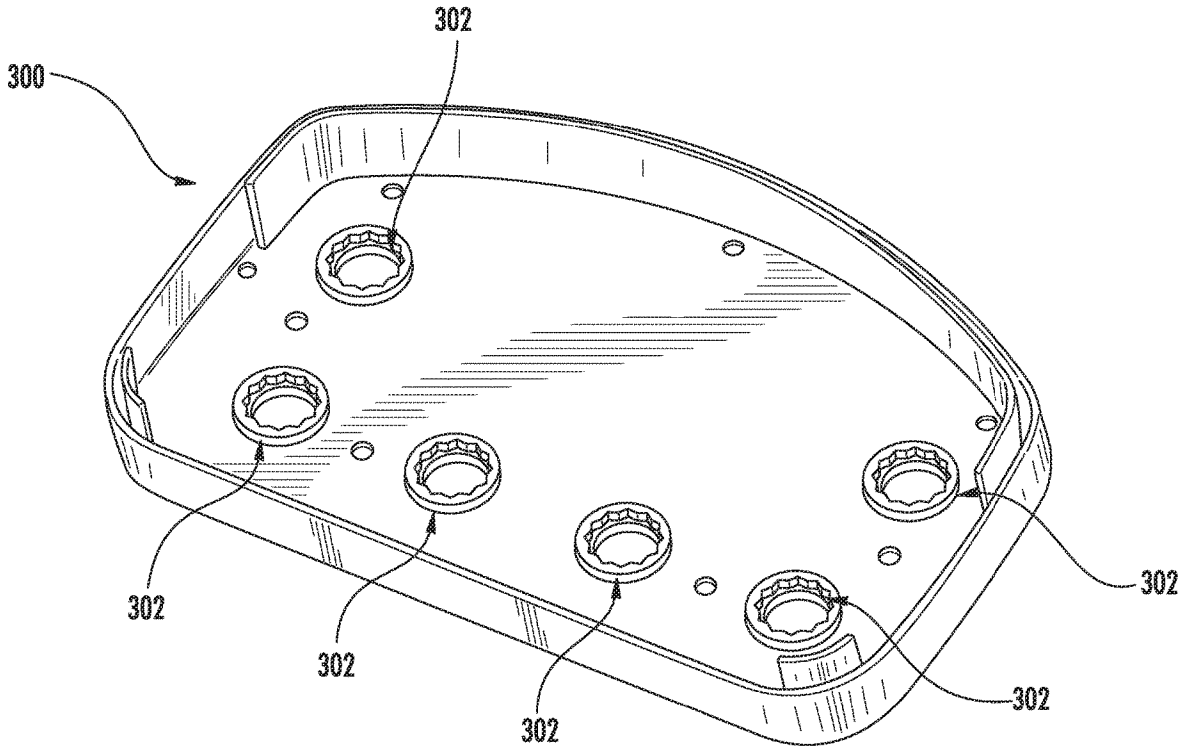
FIG. 3 is a perspective view of an inside of an end cap of a base station antenna, according to an aspect of the present disclosure.
Figure 4:
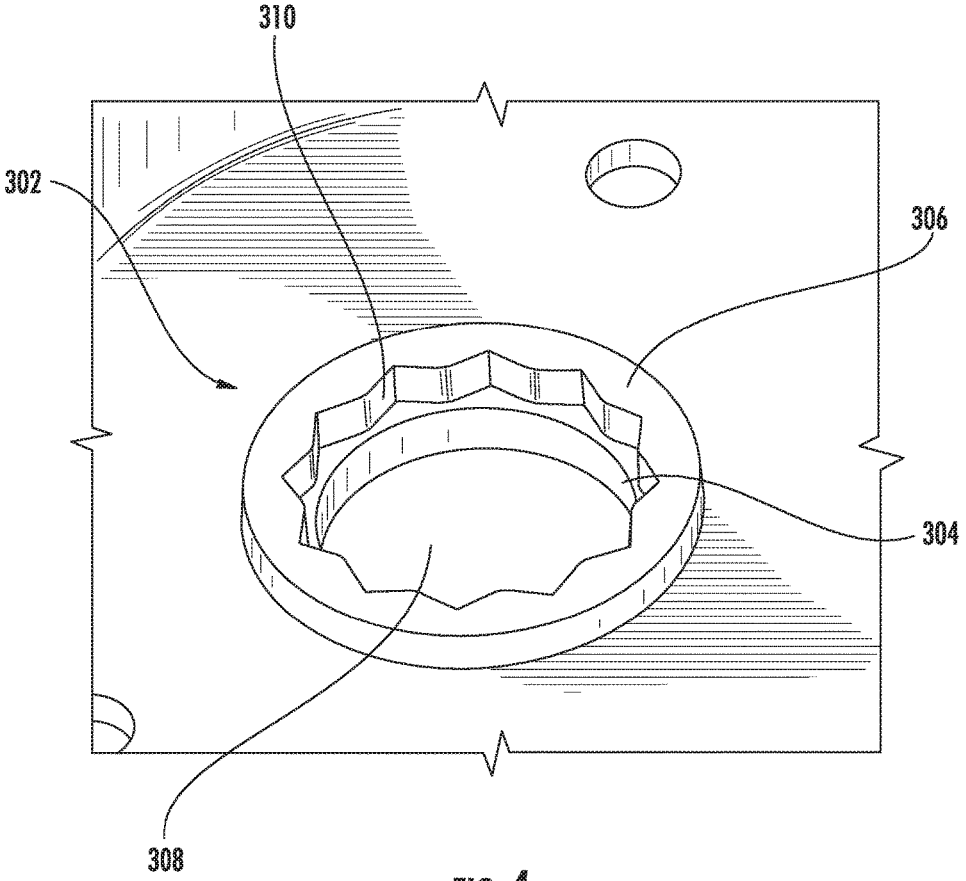
FIG. 4 is an enlarged view of the inside of the end cap, according to an aspect of the present disclosure.

FIG. 3 is a perspective view of an inside of an end cap 300 according to an aspect of the present disclosure. The inside may refer to a side of the end cap 300 facing towards the base station antenna 11. As shown, the end cap 300 may include a plurality of flanges 302 attached thereto or molded therein. As best seen in an exploded view of one of the flanges 302 in FIG. 4, each of the flanges 302 may be configured to secure the connector 200 to the end cap 300.

Each of the flanges 302 may be generally annular in shape, and may include an inner ring 304 and an outer ring 306 which define an opening 308. An inner portion of the outer ring 306 may include a plurality of discrete angled sides 310 configured to engage the sides of the polygonal portion 208 of the connector 200. In the illustrated example, the outer ring 306 includes twenty-four angled sides (i.e., the outer ring is a "12-point" ring). It should be understood, however, that the outer ring 306 may have a greater or lesser number of sides, depending upon the type of polygonal portion 208 of the connector 200 that is to be retained. The engagement of the polygonal portion 208 with the inner portion of the outer ring 308 may serve to oppose rotation of the connector 200 and ensure proper input cable alignment.

Further, such angular positions (e.g., twelve as shown) may serve to reduce, or otherwise prevent any torsional stress on any eventual input cable. For example, the connector 200 may couple a cable (e.g., a coaxial cable or other type), which may be connected to one or more components external to the antenna 11 (e.g., a base station antenna), to another cable or line (e.g., a coaxial cable or other type), which may also be connected to one or more components internal to the antenna 11 (e.g., a drive shaft, one or more phase shifters, and the like). To secure the external cable to the antenna 11, a mating portion of the external cable may be rotated. However, at least because the internal cable may be coupled (e.g., soldered or otherwise affixed) to an end of the connector 200, rotation of the mating portion of the external cable may cause torsional stress on the joint (e.g., the input solder joint) connecting the internal cable to the connector 200. This torsional stress may lead to increased PIM, potentially degrading the performance of the antenna 11. As such, by having an increased number of the above mentioned angular sides, increased alignment freedom is given to the connector 200 as well as the cable joint connected thereto.

Figure 5:
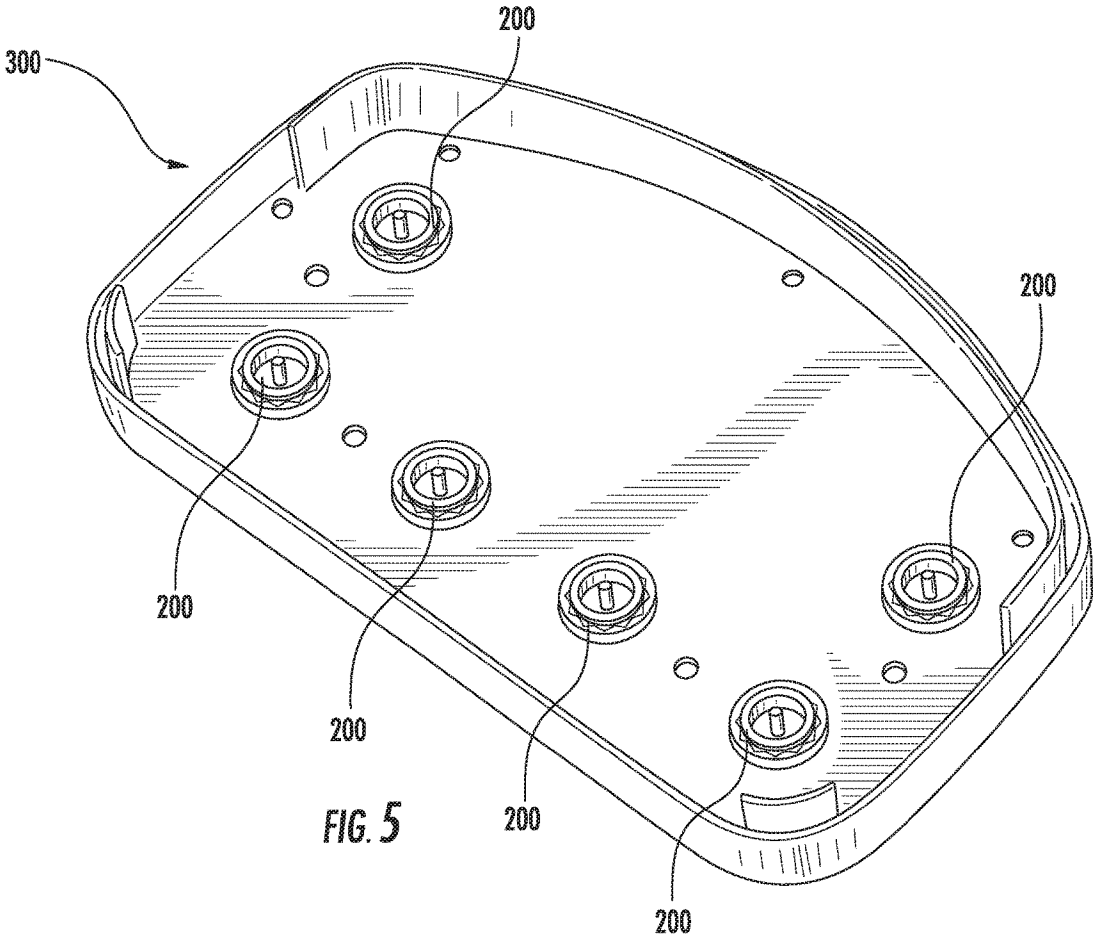
FIG. 5 is a perspective view of the inside of the end cap with each of the retaining assemblies of the end cap having a connector secured thereto, according to an aspect of the present disclosure.

FIG. 5 is an inside view of the end cap 300 showing several connectors 200 secured thereto. As shown, each of the openings 308 (of FIG. 3) of the end cap 300 may be filled with a connector 200. However, such a configuration is by way of non-limiting example only. For example, as discussed above, the end cap 300 may be used with various different antenna configurations, some of which may employ fewer connectors 200 than the number of existing openings 308 in the end cap 300. As such, any unused openings 308 may be filled with a filler panel (not shown), which may be snapped, or otherwise secured in place, to seal and protect the antenna from adverse environmental conditions.

Figure 6A:
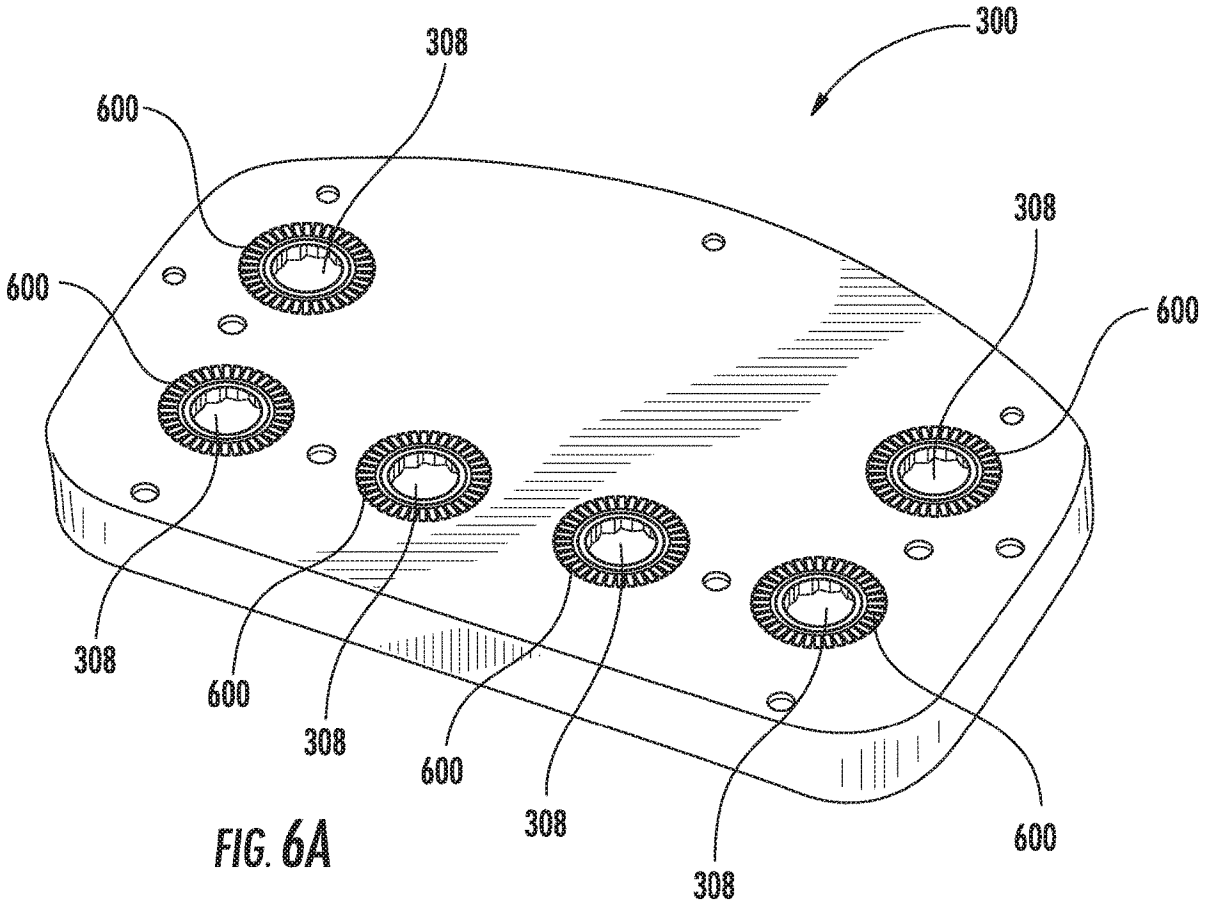
FIG. 6A is a perspective view of the outside of the end cap without any connectors connected thereto, according to an aspect of the present disclosure.
Figure 6B:
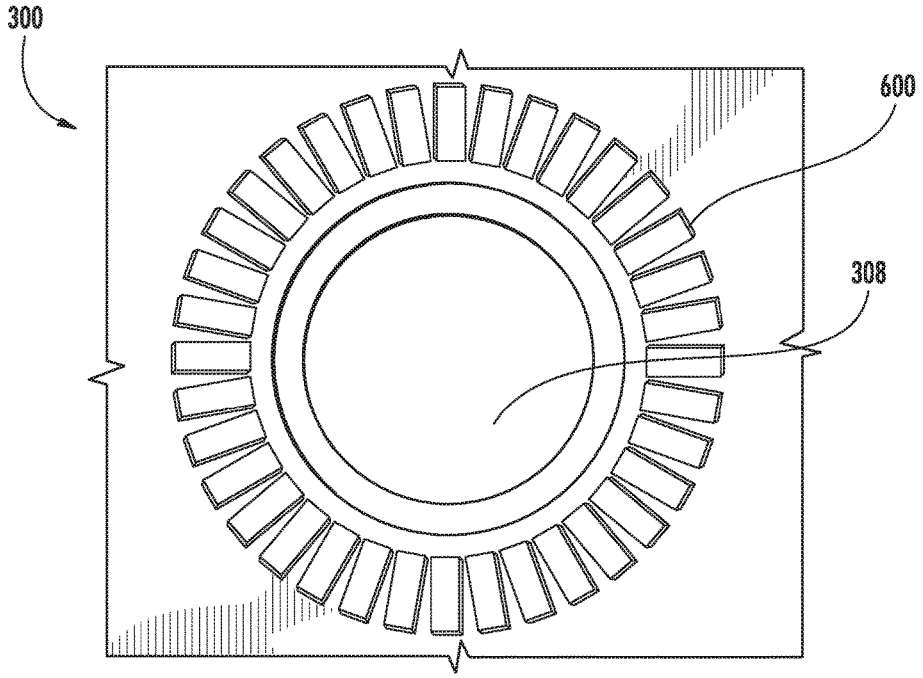
FIG. 6B is an enlarged plan view of the outside of the end cap without any connectors connected thereto, according to an aspect of the present disclosure.

Referring now to FIGS. 6A and 6B, a perspective view and an enlarged plan view of the outside of the end cap 300, are shown respectively. The outside of the end cap 300 may refer to a side of the end cap 300 facing away from the base station antenna, or, in other words, the side opposite the inside of the end cap. As shown, serrations 600 may encircle each of the openings 308 to mate with serrations 709 on a fastener, such as, for example, a flange nut 700 as shown in FIGS. 7A and 7B.

Figure 7B:
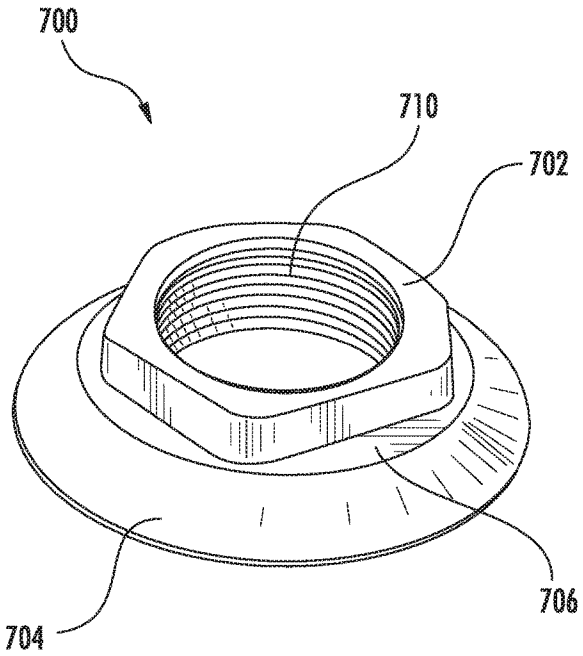
FIGS. 7A and 7B are perspective views of a flange nut, according to an embodiment of the present disclosure.
Figure 7A:
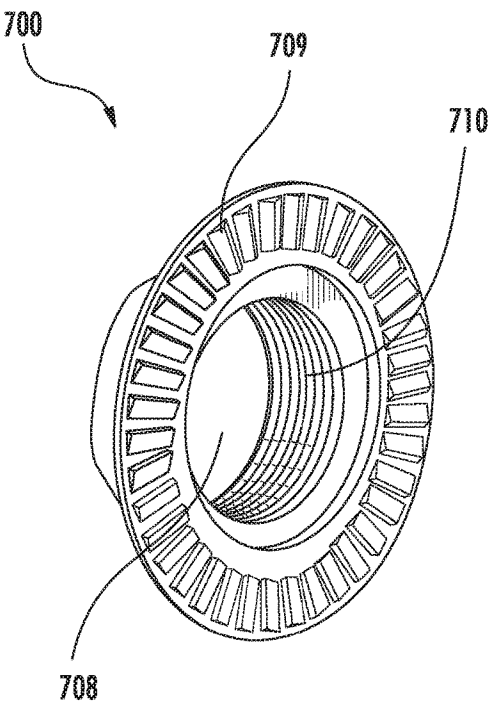

Referring now to FIGS. 7A and 7B, the flange nut 700 may include an upper region 702 and a flared region 704. The upper region 702 may be generally hexagonal in shape to facilitate gripping with pliers, a wrench, or other tightening tools. It should be noted, however, that the upper region 702 may include other polygonal shapes in keeping with the disclosure. The flared region 704 may end at a circular flat step 706 located intermediate the upper region 702 and the flared region 704. The flared region 704 preferably tapers outwardly from the circular flat step 706. A bore 708 may run through both the upper and flared regions 702 and 704, respectively, of the flange nut 700. As best seen in FIG. 7A, the flange nut 700 may include serrations 709 to mate with serrations 600 of the end cap 300. Such mating increases security and reduces risk of push out. For example, the serrations 709 and 600 mate so that more torque is need to loosen than tighten the flange nut 700. As shown in FIGS. 7A and 7B, the length of the bore 708 may be provided with threads 710 sized to accept and communicate with the threads of the connector 200. The flange nut 700 may be made from a high strength polymer material or ST (Super Tough) Nylon as known in the art, to aid in the reduction, or prevention of PIM.

Figure 8:
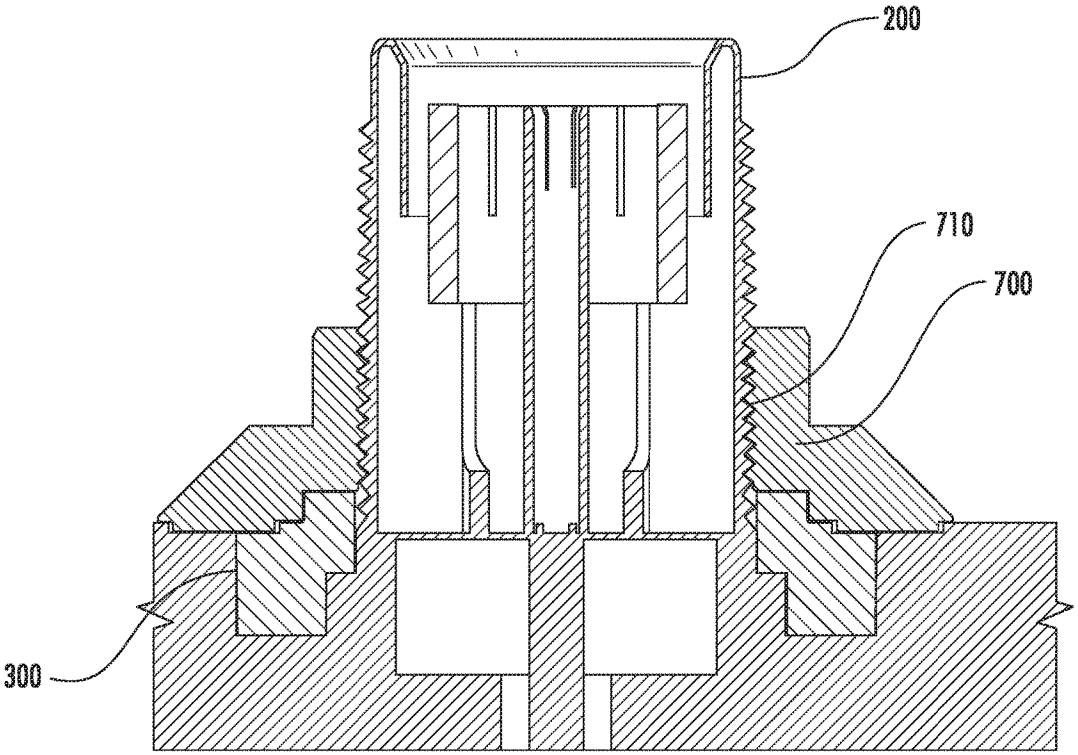
FIG. 8 is a cross sectional view of the connector secured to the end cap, according to an aspect of the present disclosure.

A cross sectional view of the connector 200 secured to the end cap 300 with the flange nut 700 is shown in FIG. 8. As shown, the threads 710 of the flange nut 700 are mated with the threads of the connector 200. Further, the serrations 709 of the flange nut 700 mate with the serrations 600 of the end cap 300 with the flange nut 700 abutting the end cap 300.

Figure 9:
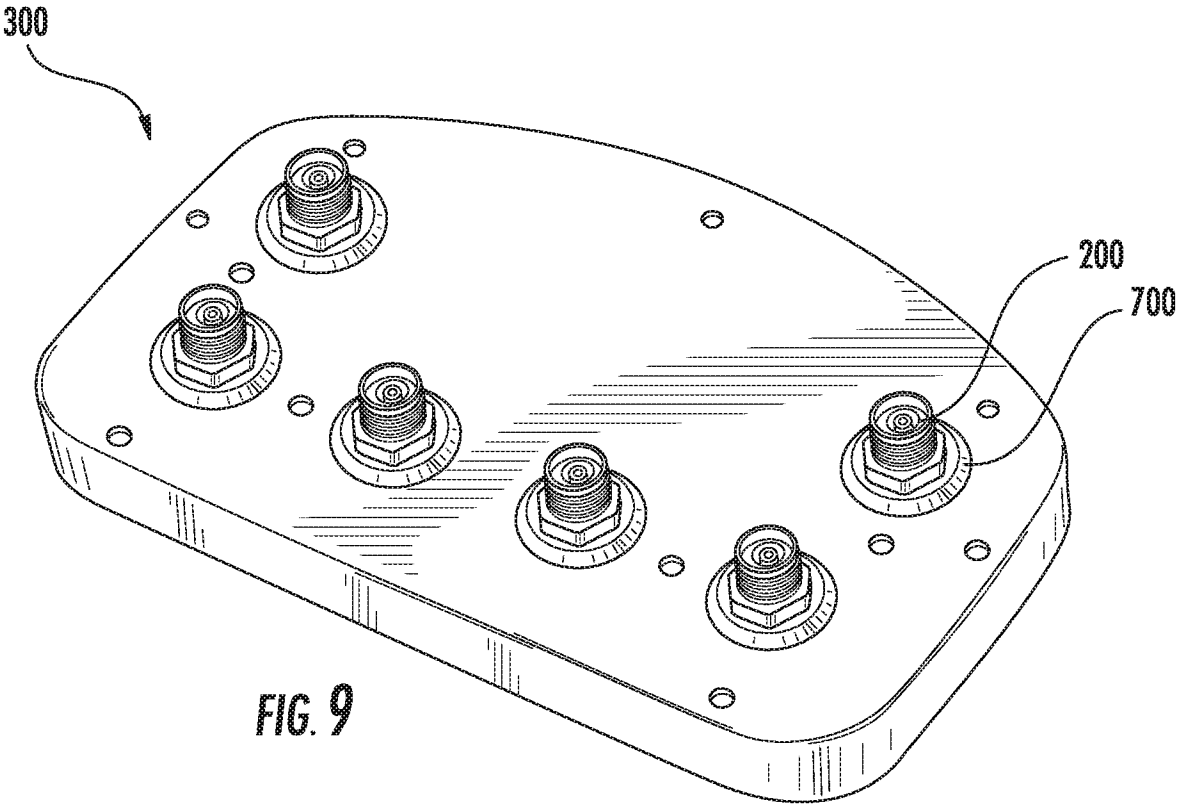
FIG. 9 is a perspective view of the outside of the end cap with the connectors secured thereto, according to an aspect of the present disclosure.

FIG. 9 is a perspective view of the outside of the end cap 300 after the desired connectors 200 have been secured to the end cap 300.

Figure 10:
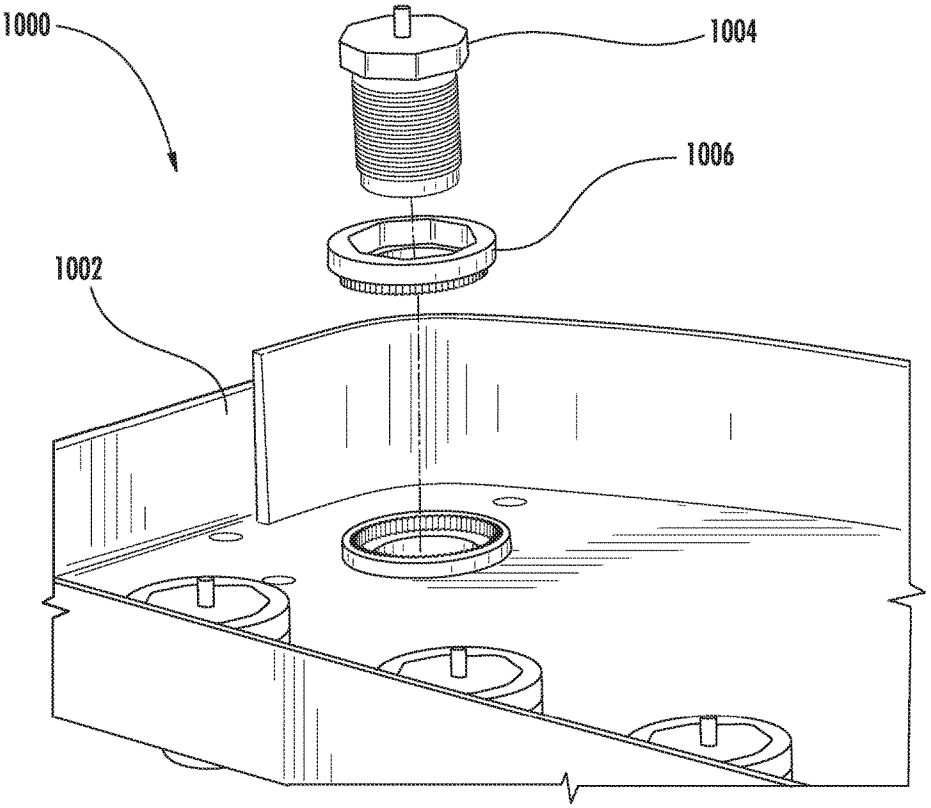
FIG. 10 is a perspective view of an end cap assembly including another end cap, connector, indexing ring, and serrated flange nut according to an aspect of the present disclosure.
Figure 11A:
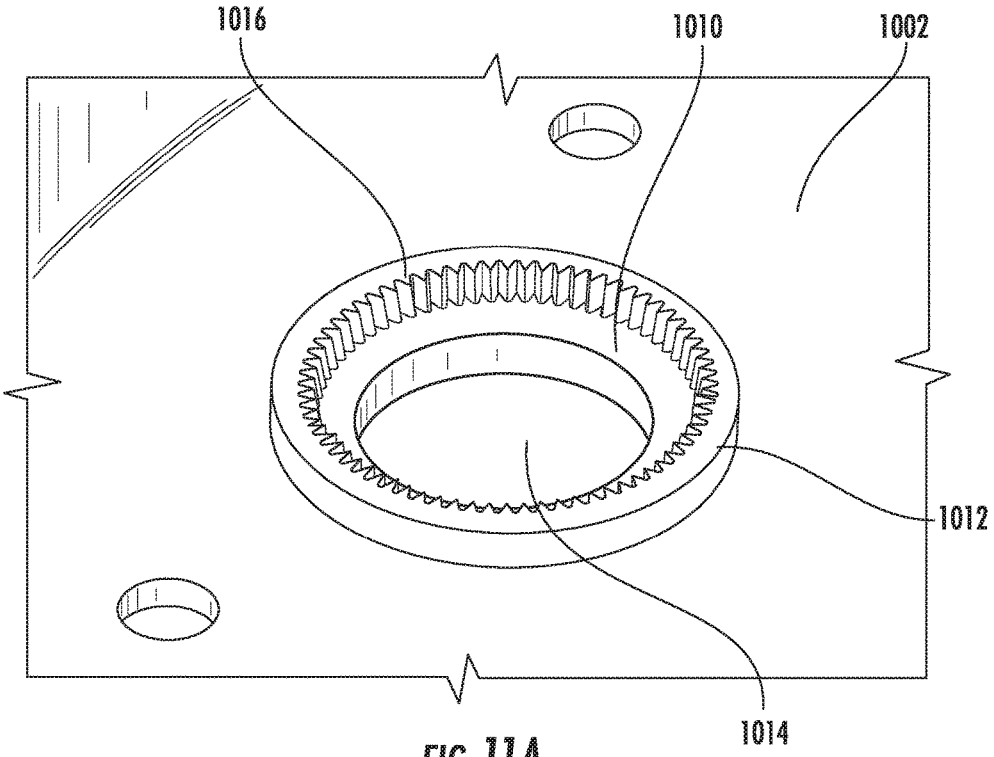
FIG. 11A is an enlarged perspective view of one of the flanges on the inside of the end cap, according to an aspect of the present disclosure.
Figure 11B:
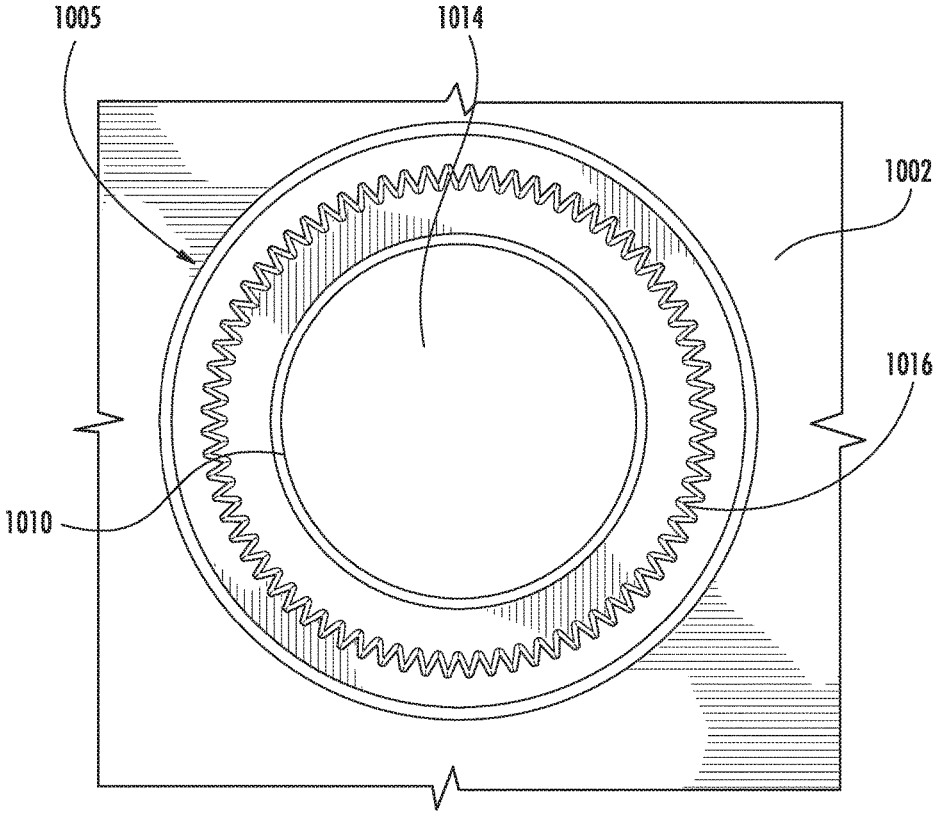
FIG. 11B is an enlarged plan view of one of the flanges on the inside of the end cap, according to an aspect of the present disclosure.

According to other aspects of the present disclosure, as shown in FIG. 10, an end cap assembly 1000 may include an end cap 1002, a connector 1004, an indexing ring 1006, and the serrated flange nut 700. As shown, an inside of the end cap 1002 may include a plurality of flanges 1005 attached thereto or molded therein. As best seen in an enlarged view of one of the flanges 1005 in FIG. 11A, and the plan view of the same in FIG. 11B, each of the flanges 1005 may be configured to secure the connector 1004 to the end cap 1002. The flange 1005 may be generally annular in shape, and may include an inner ring 1010 and an outer ring 1012 which define an opening 1014. An inner portion of the outer ring 1012 may include axial grooves (or teeth) 1016 along its periphery.

Figure 12:
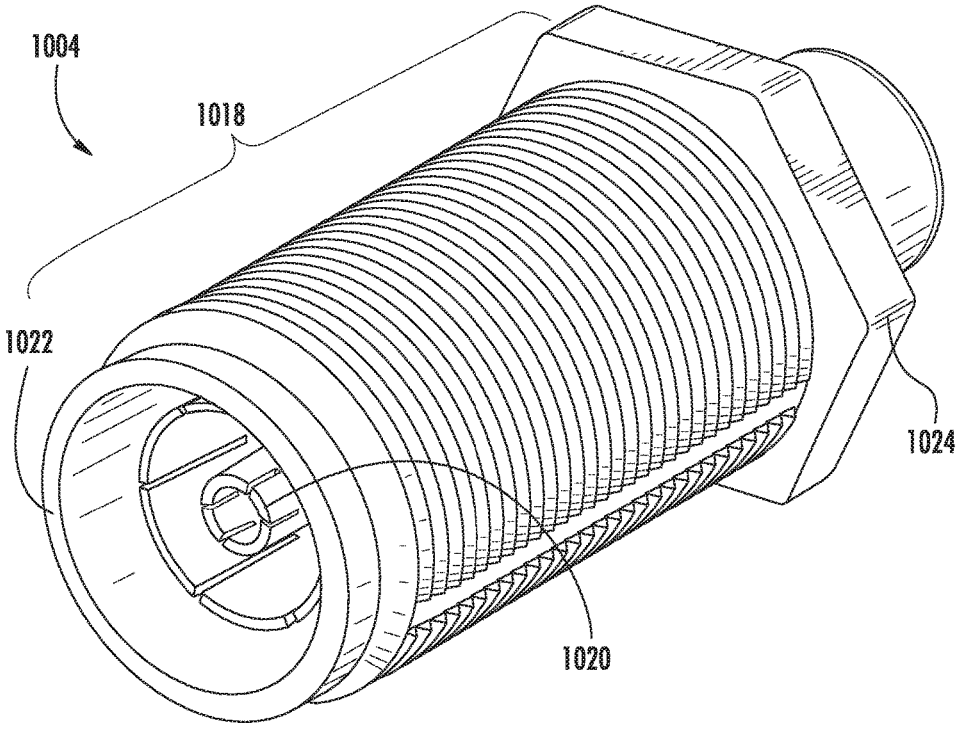
FIG. 12 is a perspective view of another connector according to an aspect of the present disclosure.

FIG. 12 is a perspective view of the connector 1004 which may be employed according to aspects of the disclosure. The connector 1004 may be made from an electrically conductive material (such as, for example, brass). The connector 1004 may include communications contacts housed in a body 1018 for communicatively connecting elements joined thereto. For example, FIG. 12 shows the body 1018 housing an inner contact 1020 and an outer contact 1022 that provide a conductive path or other communication mechanism between the connector 1004 and elements connected thereto. The body 1018 may also include a polygonal portion 1024. The connector 1004 may preferably take the form of a 4.3/10 bulkhead connector. However, it should be noted that the connector 1004 may also take the form of a 7/16 Deutsches Institut für Normung (or "DIN") female connector. Alternate communications contacts are also possible, depending on the configuration of elements to be connected.

Figure 13:
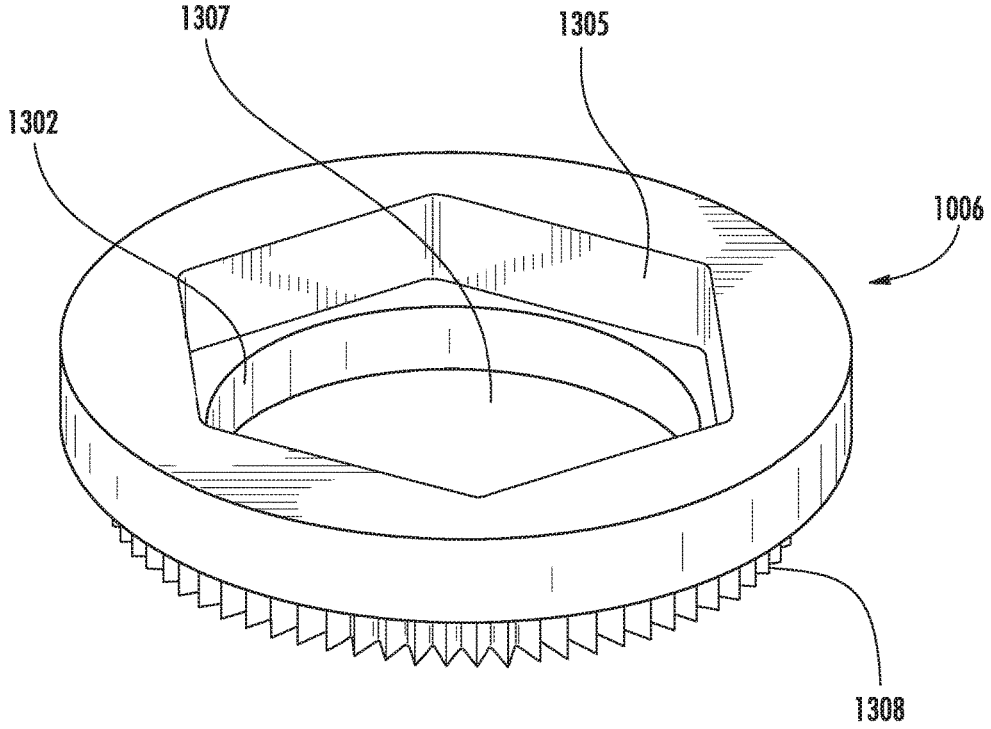
FIG. 13 is a perspective view of an indexing ring, according to an aspect of the present disclosure.
Figure 14B:
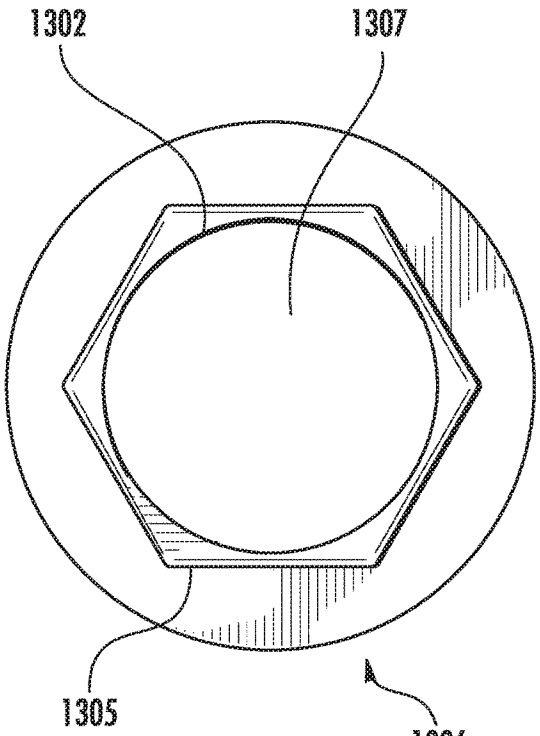
FIG. 14B is a plan view of a top side, opposite the underside of the indexing ring, according to an aspect of the present disclosure.
Figure 14A:
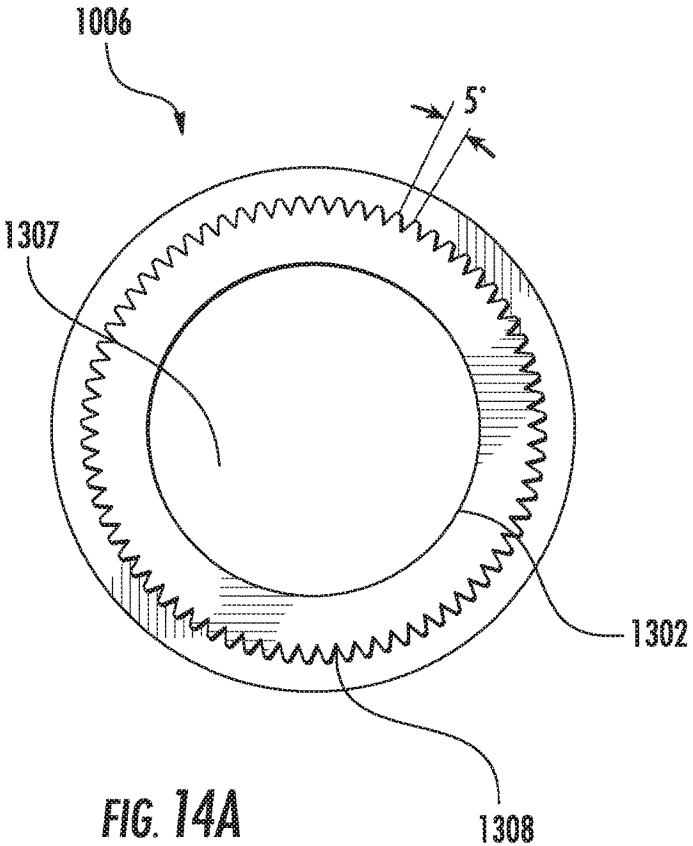
FIG. 14A is a plan view of an underside of the indexing ring, according to an aspect of the present disclosure.

FIG. 13 is a perspective view of one of the indexing rings 1006. Further, FIGS. 14A and 14B are plan views of one of the indexing rings 1006. The indexing ring 1006 may be made from a high strength polymer material, such as ST (Super Tough) Nylon as known in the art. For example, FIG. 14A is a plan view of an underside of the indexing ring 1006 which would be mated to the grooves 1016 of the flange 1005. FIG. 14B is a plan view of a side opposite the underside, (e.g., the top) which would be mated to the polygonal portion 1024 of the connector 1004. As shown in FIG. 14B, the top of the indexing ring 1006 may be generally annular in shape, and may include the inner ring 1302 and an outer ring 1305 which define an opening 1307. Edges of the outer ring 1305 may define a hexagonal shape, although other polygonal shapes may be defined herein without departing from the disclosure. The inner portion of the inner ring 1302 is circular in shape. However, other shapes may be contemplated without departing from the disclosure.

As best shown in FIGS. 13 and 14A, along an outer periphery of a portion of the indexing ring 1006 are axially extending teeth 1308 which may be formed to substantially mate with the grooves 1016 of the flange 1005. As shown, the indexing ring 1006 includes 72 axially extending teeth. However, the indexing ring may include a fewer or greater number of teeth in keeping with the disclosure. As shown, the axially extending teeth 1308 are angularly spaced approximately 5 degrees apart from one another. However, it should be noted that, a smaller or greater angular spacing may be employed in keeping with the disclosure. The engagement of the polygonal portion 1024 of the connector 1004 with the edges (e.g., defining the hexagonal shape) of the outer ring 1305 may serve to oppose rotation of the connector 1004 and ensure proper input cable alignment.

Further, the radially extending teeth 1308 may serve to reduce, or otherwise prevent any torsional stress on any eventual input cable. For example, the connector 1004 may couple a cable (e.g., a coaxial cable or other type), which may be connected to one or more components external to the antenna 11 (e.g., a base station antenna), to another cable or line (e.g., a coaxial cable or other type), which may also be connected to one or more components internal to the antenna 11 (e.g., a drive shaft, one or more phase shifters, and the like). To secure the external cable to the antenna 11, a mating portion of the external cable may be rotated. However, at least because the internal cable may be coupled (e.g., soldered or otherwise affixed) to an end of the connector 1004, rotation of the mating portion of the external cable may cause torsional stress on the joint (e.g., the input solder joint) connecting the internal cable to the connector 1004. This torsional stress may lead to increased PIM, potentially degrading the performance of the antenna 11. As such, by having an increased number of the above mentioned teeth 1308, increased alignment freedom is given to the connector 1004 (e.g., coupled to the indexing ring 1006) as well as the cable joint connected thereto. For example, according to the end cap assembly 1000, the indexing ring 1006 allows for 5 degree angular indexing positions, which serves to reduce such torsional stress.

Figure 15:
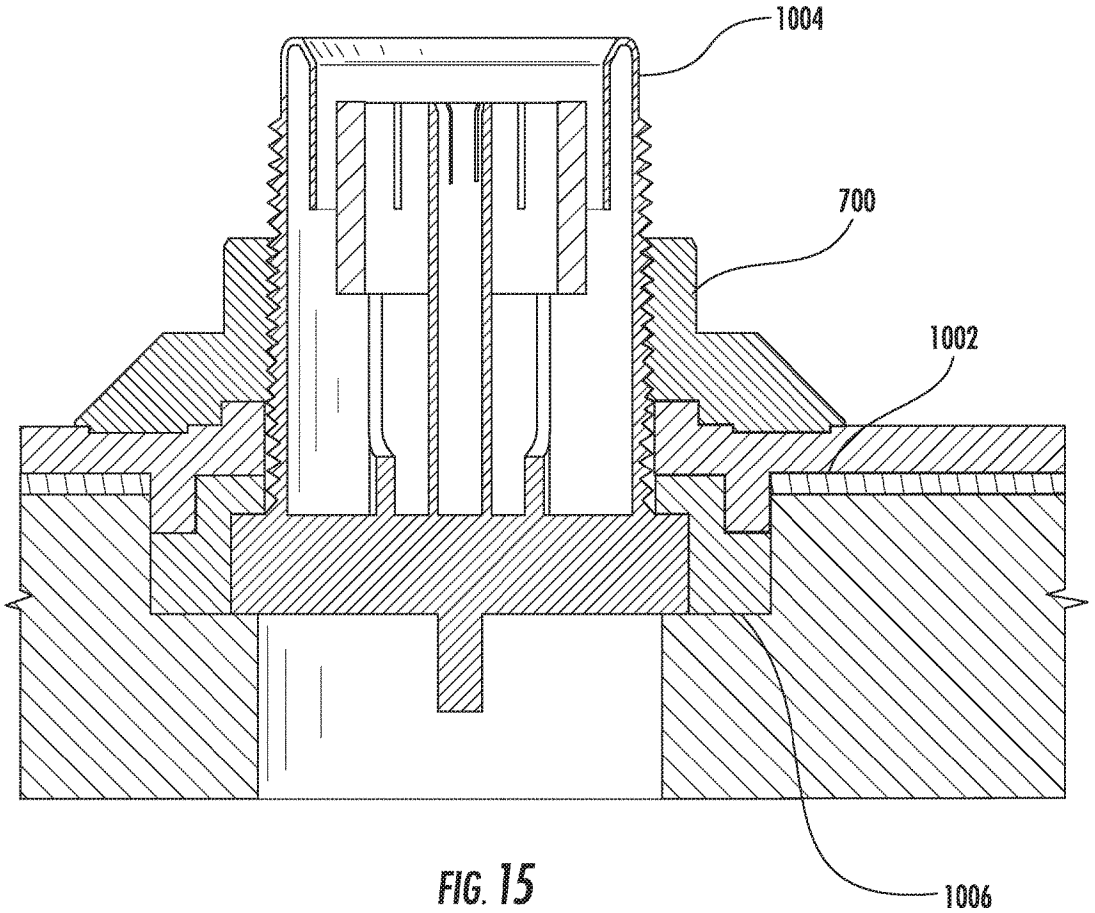
FIG. 15 is a cross sectional view of the connector secured to the end cap with the flange nut and indexing ring according to an aspect of the present disclosure.
Figure 16:
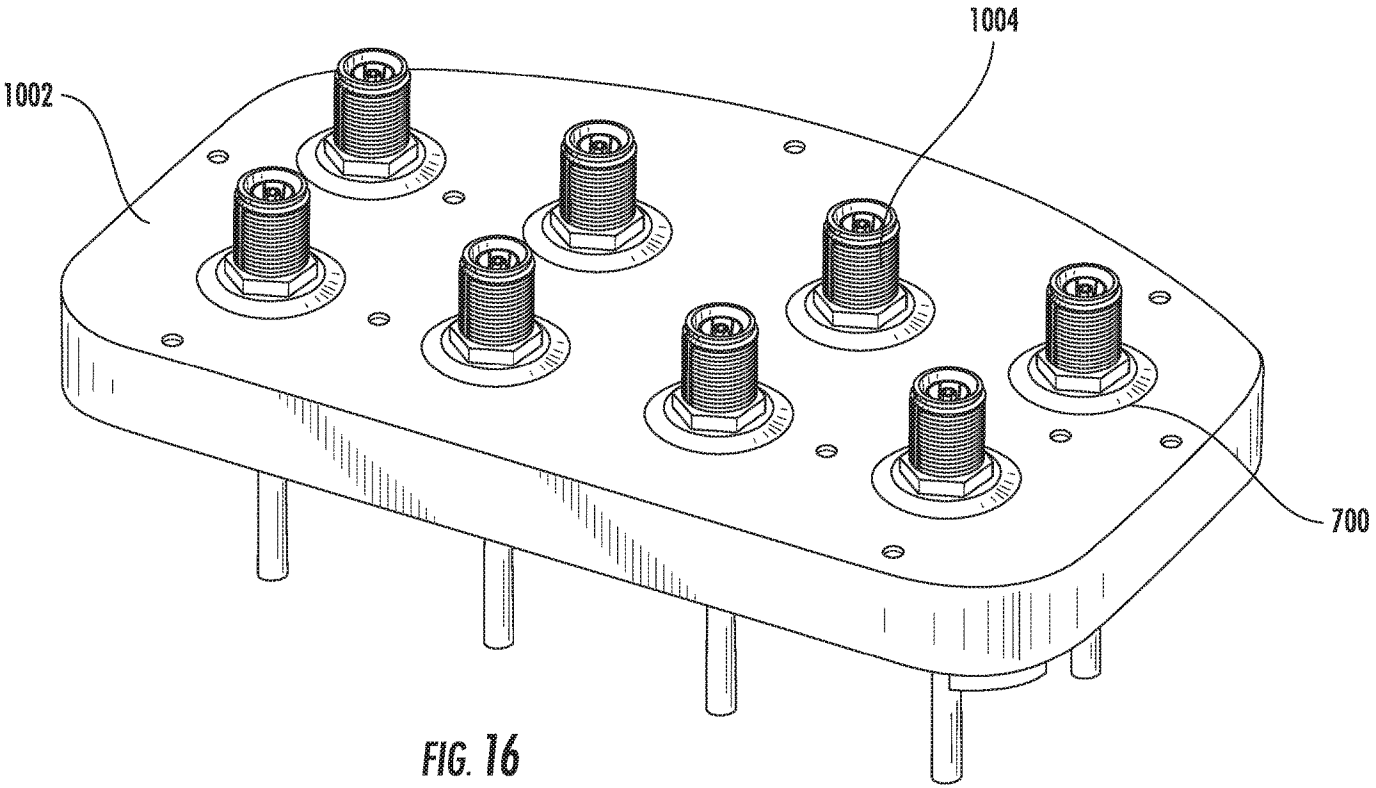
FIG. 16 is a perspective view of the outside of the end cap with the connectors secured thereto, according to an aspect of the present disclosure.

A cross sectional view of the connector 1004 secured to the end cap 1002 with the flange nut 700 and indexing ring 1006 is shown in FIG. 15. After installation, an example of the perspective view of the end cap 1002 is shown in FIG. 16.

Various embodiments of the disclosure have now been discussed in detail; however, the disclosure should not be understood as being limited to these embodiments. It should also be appreciated that various modifications, adaptations, and alternative embodiments thereof may be made within the scope and spirit of the present disclosure.

What is claimed is:

1. An end cap assembly for connecting a cable to an end cap, comprising:

an end cap including one or more flanges, each of the one of more flanges include a plurality of edges defining a cavity, the plurality of edges being configured to mate with a portion of a connector;

a flange nut including a first plurality of serrations configured to mate with a second plurality of serrations on an outside of the end cap; wherein the flange nut and the flange are formed so as to allow for attachment of the cable to the end cap.

2. The assembly defined in claim 1, further comprising a connector mounted in the cavity.

3. The assembly defined in claim 1, wherein the plurality of edges defines a 12-point ring.

4. The assembly defined in claim 1, wherein the plurality of edges defines a 72 point ring.

5. The assembly defined in claim 1, further comprising an indexing ring that mates with the flange.

6. The assembly defined in claim 1, wherein one or more flanges is a plurality of flanges.

7. An end cap assembly for connecting a cable to an end cap, comprising:

an end cap including one or more generally circular flanges surrounding a hole, each of the one of more flanges include a plurality of edges defining a cavity, the plurality of edges being configured to mate with a portion of a connector;

a flange nut including a first plurality of serrations configured to mate with a second plurality of serrations on an outside of the end cap;

wherein the flange nut, the hole and the flange are formed so as to allow for insertion and capture of a connector in the end cap.

8. The assembly defined in claim 7, further comprising a connector mounted in the cavity.

9. The assembly defined in claim 7, wherein the plurality of edges defines a 12-point ring.

10. The assembly defined in claim 7, wherein the plurality of edges defines a 72 point ring.

11. The assembly defined in claim 7, further comprising an indexing ring that mates with the flange.

12. The assembly defined in claim 7, wherein one or more flanges is a plurality of flanges.

* * * * *